US010017289B2

(12) United States Patent
Yamamura

(10) Patent No.: US 10,017,289 B2
(45) Date of Patent: Jul. 10, 2018

(54) PACKAGING BOX

(71) Applicant: KYOCERA Document Solutions Inc., Osaka-shi, Osaka (JP)

(72) Inventor: Kazuyoshi Yamamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 225 days.

(21) Appl. No.: 14/994,933

(22) Filed: Jan. 13, 2016

(65) Prior Publication Data

US 2016/0214758 A1 Jul. 28, 2016

(30) Foreign Application Priority Data

Jan. 22, 2015 (JP) ..... 2015-009919

(51) Int. Cl.

| | |
|---|---|
| ***B65D 5/02*** | (2006.01) |
| ***B65D 5/42*** | (2006.01) |
| ***B65D 5/54*** | (2006.01) |
| ***B65D 85/00*** | (2006.01) |
| ***B65D 5/66*** | (2006.01) |

(52) U.S. Cl.

CPC ..... *B65D 5/0254* (2013.01); *B65D 5/4266* (2013.01); *B65D 5/541* (2013.01); *B65D 5/6608* (2013.01); *B65D 85/70* (2013.01); *B65D 2585/689* (2013.01)

(58) Field of Classification Search

CPC .... B65D 5/0254; B65D 5/4266; B65D 5/541; B65D 5/6608; B65D 5/6644; B65D 85/70; B65D 2585/689

USPC ..... 206/525

See application file for complete search history.

(56) References Cited

U.S. PATENT DOCUMENTS 5,123,589 A * 6/1992 Cote ..... B65D 5/545 206/455

5,924,625 A * 7/1999 Klein ..... B65D 5/18 229/103.3

FOREIGN PATENT DOCUMENTS

| | | |
|---|---|---|
| JP | S53-154116 U | 12/1978 |
| JP | 2005-096857 A | 4/2005 |
| JP | 2005-153983 A | 6/2005 |
| JP | 2010-285179 A | 12/2010 |
| JP | 2013-184720 A | 9/2013 |

* cited by examiner

*Primary Examiner* — Anthony Stashick
*Assistant Examiner* — James M Van Buskirk
(74) *Attorney, Agent, or Firm* — Studebaker & Brackett PC

(57) ABSTRACT

A packaging box (1) includes a storage part (2), an inner flap (21) and an outer flap (22). The inner flap (21) is provided with a slit (31) along an edge (11*a*) and the outer flap (12) is provided with an insertion piece (41) connected to a tip edge (22*a*) via a bending line (42). The insertion piece (41) is inserted into the slit (31) by being bent along the bending line (42). The insertion piece (41) has an engaging piece (45) configured to be foldable along a folding line (44) extending in a direction crossing the tip edge (22*a*) and to have an engaging edge (45*a*) facing the tip edge (22*a*). When the engaging piece (45) is folded along the folding line (44), the engaging edge (45*a*) is inclined downward toward its distal end.

7 Claims, 7 Drawing Sheets

PACKAGING BOX

INCORPORATION BY REFERENCE

This application is based on and claims the benefit of priority from Japanese Patent application No. 2015-009919 filed on Jan. 22, 2015, the entire contents of which are incorporated herein by reference.

BACKGROUND

The present disclosure relates to a packaging box that stores consumable supplies or the like.

Packaging boxes for consumable supplies and materials, such as a toner cartridge, are often unsealed by cutting along a breaking portion, such as a zipper, in order to clearly check whether or not the packaging box is unsealed. Such a packaging box is configured such that a cover provided with the breaking portion is adhered to a main body of the packaging box by an adhesive or the like. Therefore, the packaging box cannot be unsealed as long as the cover is not cut along the breaking portion. In addition, in order to reduce cost for the adhering processing of the cover to the main body, it is sometimes likely that the cover is constructed by an inner flap and an outer flap, a slit is provided in the inner flap, and an insertion piece that is inserted into and engaged with the slit is provided in the outer flap. The insertion piece is formed with an engaging piece configured to be insertable into the slit by being folded and to be unfolded after the insertion into the slit to prevent the insertion piece from being pulled out of the slit.

The above packaging box will be described with reference to FIG. 7A, FIG. 7B and FIG. 7C. As shown in FIG. 7A, along a tip edge of an outer flap 100, an insertion piece 102 is connected via a bending line 101, and along both side edges of the insertion piece 102, engaging pieces 104 are respectively connected via folding lines 103. On the other hand, an inner flap 110 is formed with a slit 111 into which the insertion piece 102 is inserted. A predetermined gap G is provided between the tip edge of the outer flap 100 and each of the engaging pieces 104. Therefore, the engaging pieces 104 can be unfolded without interfering with the slit 111 after the insertion of the insertion piece 102 into the slit 111.

However, in such a packaging box, there is a risk that if the gap G between the tip edge of the outer flap 100 and each of the engaging pieces 104 is large, the outer flap 100 is opened by its elasticity after each of the engaging pieces 104 is retained in the slit 111, and, as shown in FIG. 7B, a gap g is formed between the outer flap 100 and the inner flap 110, and the packaging box is mistaken as being unsealed. In a packaging box having a large lateral width, the gap g is particularly likely to be conspicuous.

In addition, the engaging pieces 104 are folded along the folding lines 103 extending in a direction orthogonally crossing the tip edge of the outer flap 100. However, if the engaging pieces 104 are unevenly folded, as shown in FIG. 7C, there is a risk that apart of the engaging pieces 104 is caught on the slit 111, the engaging pieces 104 are not opened after the insertion of the insertion piece 102 into the slit 111, and thus the outer flap 100 cannot be surely engaged with the inner flap 110.

SUMMARY

A packaging box according to one aspect of the present disclosure includes a storage part, an inner flap and an outer flap. The storage part has a rectangular plate and side plates respectively standing upright from four side edges of the rectangular plate. The storage part is formed with an opening on one face. The inner flap is configured to be bent inward along an edge of one side plate of a pair of the side plates facing each other. The outer flap is configured to bent bend inward along an edge of the other sideplate and to be overlapped on the inner flap to close the opening. The inner flap is provided with a slit along the edge. The outer flap is provided with an insertion piece connected to a tip edge thereof via a bending line. The insertion piece is inserted into the slit by being bent along the bending line. The insertion piece has an engaging piece. The engaging piece is configured to be foldable along a folding line extending in a direction crossing the tip edge of the outer flap and to have an engaging edge facing the tip edge of the outer flap. The engaging piece is insertable into the slit by being folded along the folding line so as to be overlapped on the insertion piece and being unfolded by its resilience and bent in a direction crossing the slit after the insertion so that the engaging edge prevents the insertion piece from being pulled out of the slit. The folding line is inclined at an obtuse angle with respect to the bending line such that when the engaging piece is folded along the folding line, the engaging edge is inclined downward toward its distal end.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, a packaging box according to one embodiment of the present disclosure will be described with reference to the drawings.

Figure 1:
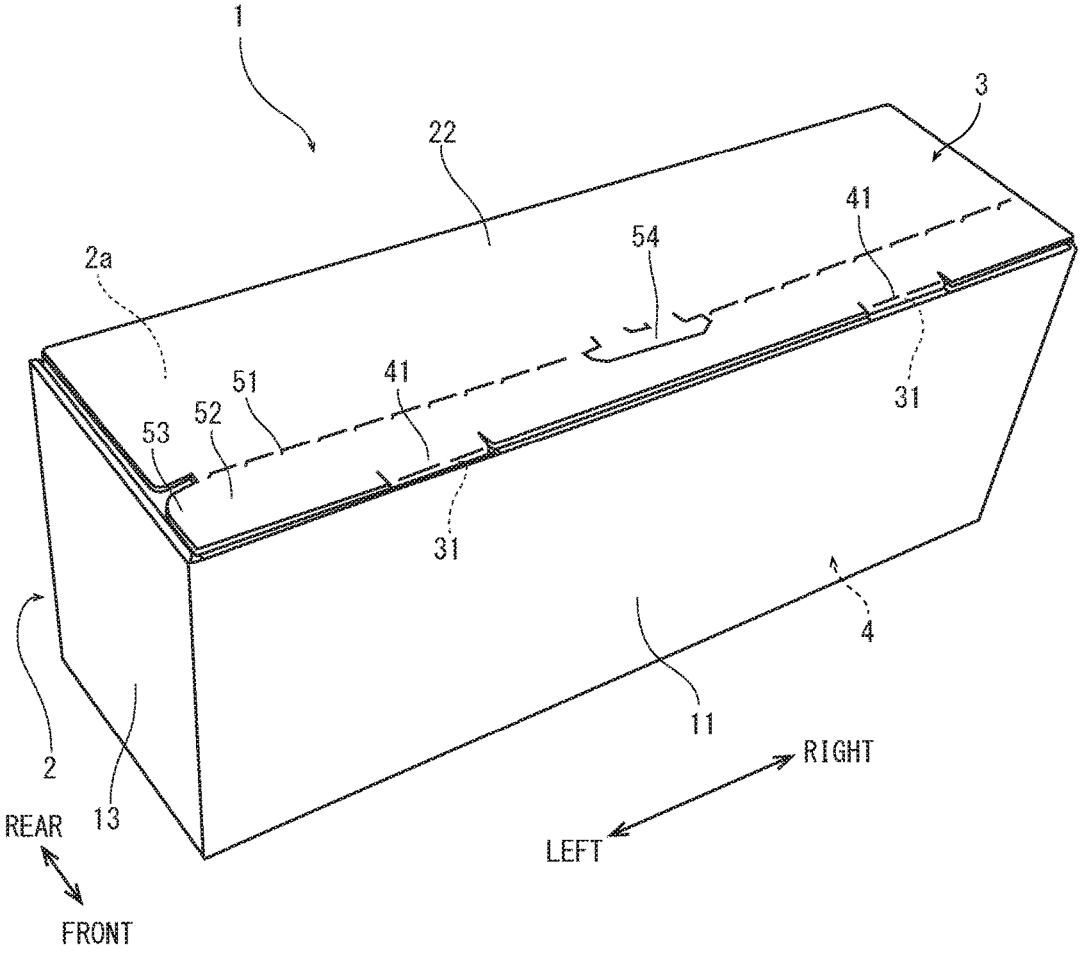
FIG. 1 is a perspective view showing a packaging box according to one embodiment of the present disclosure.
Figure 2:
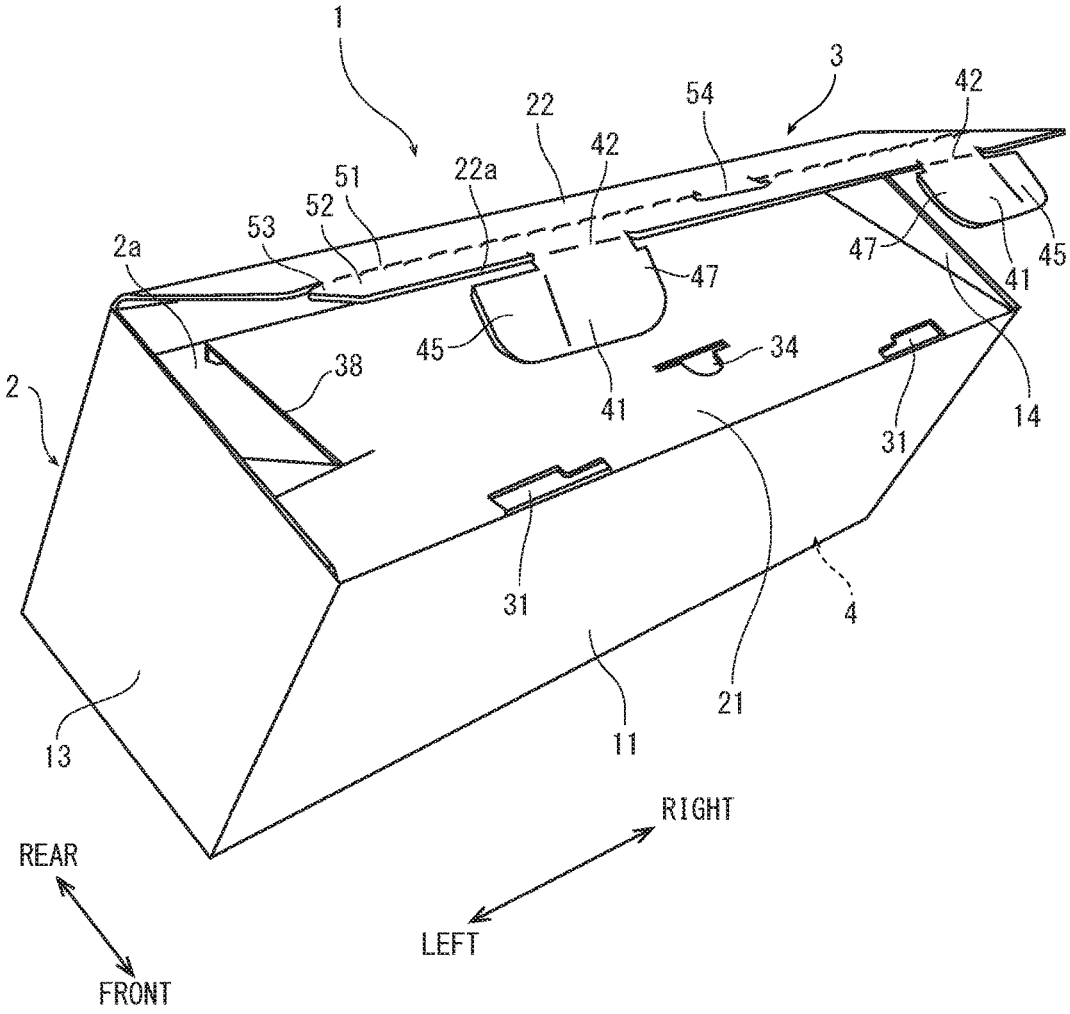
FIG. 2 is a perspective view showing the packaging box, before an outer flap is engaged with an inner flap, according to the one embodiment of the present disclosure.
Figure 3:
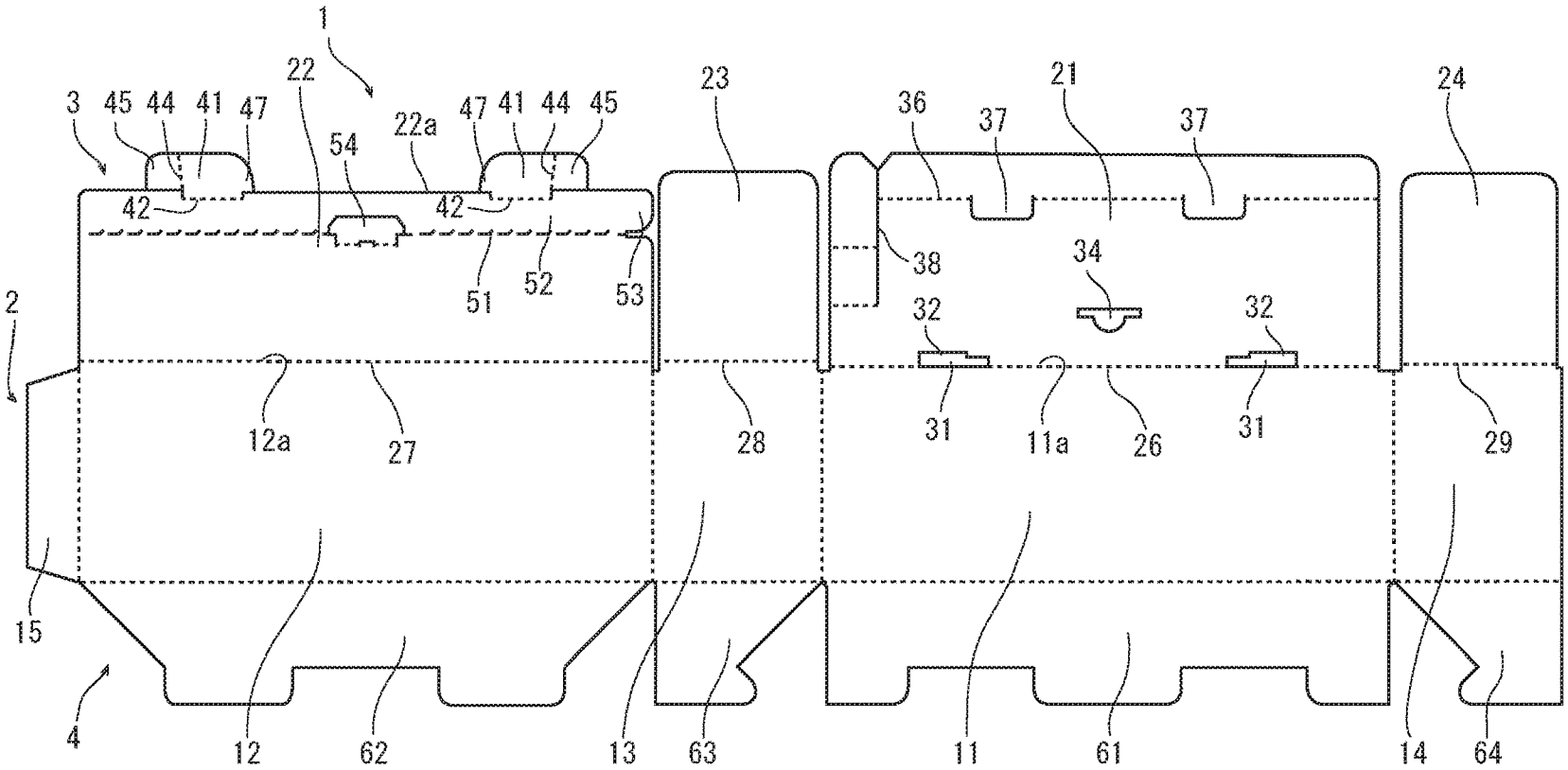
FIG. 3 is a developed view showing the packaging box according to the one embodiment of the present disclosure.

With reference to FIG. 1 to FIG. 4, the packaging box that packages a toner cartridge will be described. FIG. 1 is a perspective view showing the packaging box, FIG. 2 is a perspective view showing the packaging box before a cover is engaged, FIG. 3 is a developed view showing the packaging box, FIG. 4A is a plan view showing an insertion piece, and FIG. 4B is a diagram showing a positional relationship between an insertion piece and a slit. In the following description, front and rear directions and right and left directions show directions shown in FIG. 1 and FIG. 2.

A packaging box 1, as shown in FIG. 1 and FIG. 2, includes a square cylindrical storage part 2 with an upper opening 2*a* and a lower opening, a cover flap 3 connected to upper edges of the storage part 2 to open and close the upper opening 2*a*, and a bottom plate 4 connected to lower edges of the storage part 2 to close the lower opening, and is formed by assembling one sheet material as shown in FIG. 3. As the sheet material, for example, a high strength cardboard material having a corrugated medium can be used. In the corrugated cardboard material, a ridgeline direction of the corrugating medium corresponds to upper and lower directions of the packaging box 1.

The storage part 2 has a pair of opposing front and rear side plates 11 and 12, and a pair of opposing right and left side plates 13 and 14. As shown in FIG. 3, the pair of front and rear side plates 11 and 12 and the pair of right and left side plates 13 and 14 are alternately connected via bending lines. An adhering piece 15 is connected along a side edge of the rear side plate 12. By bending each of the side plates 11, 12, 13 and 14 inward at a right angle along each of the bending lines and then adhering the adhering piece 15 to the right side plate 14, the square cylindrical storage part 2 having the upper and lower openings is formed.

The cover flap 3 has an inner flap 21, an outer flap 22 and cover receiving flaps 23 and 24. The inner flap 21 and the outer flap 22 are respectively connected along upper tip edges 11*a* and 12*a* of the front and rear side plates 11 and 12 via bending lines 26 and 27. The cover receiving flaps 23 and 24 are respectively connected along upper tip edges of the right and left side plates 13 and 14 via bending lines 28 and 29. The cover flaps 3 opens and closes the upper opening 2*a* of the storage part 2.

The inner flap 21 is formed with two slits 31 along the bending line 26 at a predetermined interval. Along an inside edge of each of the slits 31, a wide portion 32 having a width larger than the width of the slit 31 in a width direction perpendicular to the length direction of the slit 31 is stepwisely formed.

In addition, the inner flap 21 is formed with an insertion hole 34 slightly inside of the bending line 26 in the vicinity of the center in the right and left directions. The insertion hole 34 has a rectangle-shape portion elongated in the right and left directions and a semicircle-shape portion. Further, in a tip portion of the inner flap 21, a bending line 36 parallel with the bending line 26 is formed. Along the bending line 36, cut and raised pieces 37 are formed at a predetermined interval. Further, in a left end portion of the inner flap 21, a cut line 38 orthogonally crossing the bending line 26 from the tip edge of the inner flap 21 is formed.

Figure 4A:
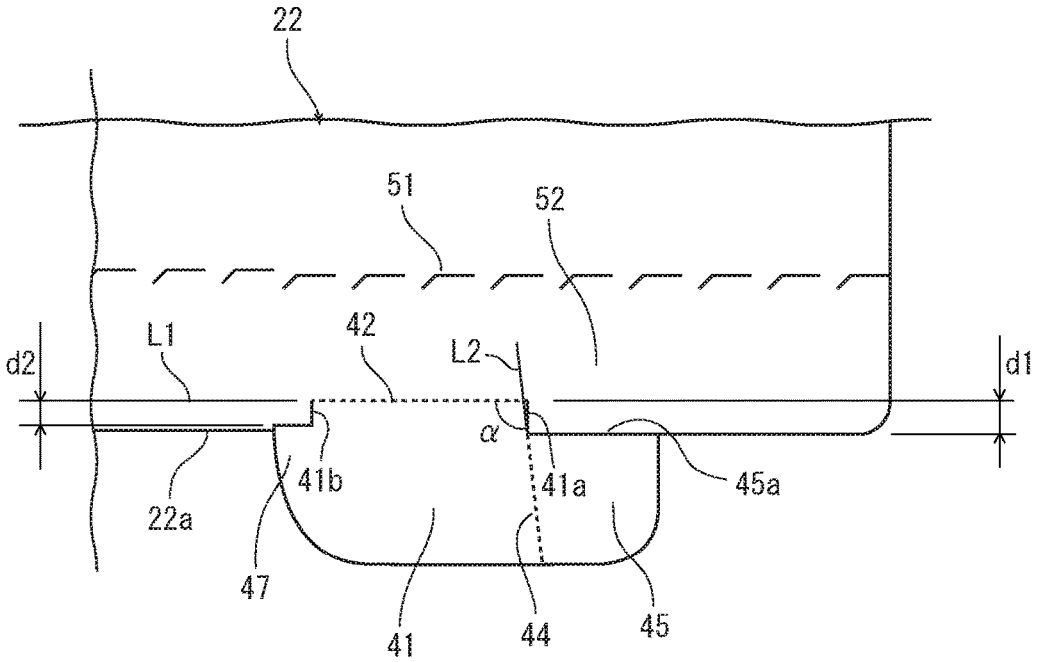
FIG. 4A is a plan view showing an insertion piece of the packaging box according to the one embodiment of the present disclosure.
Figure 4B:
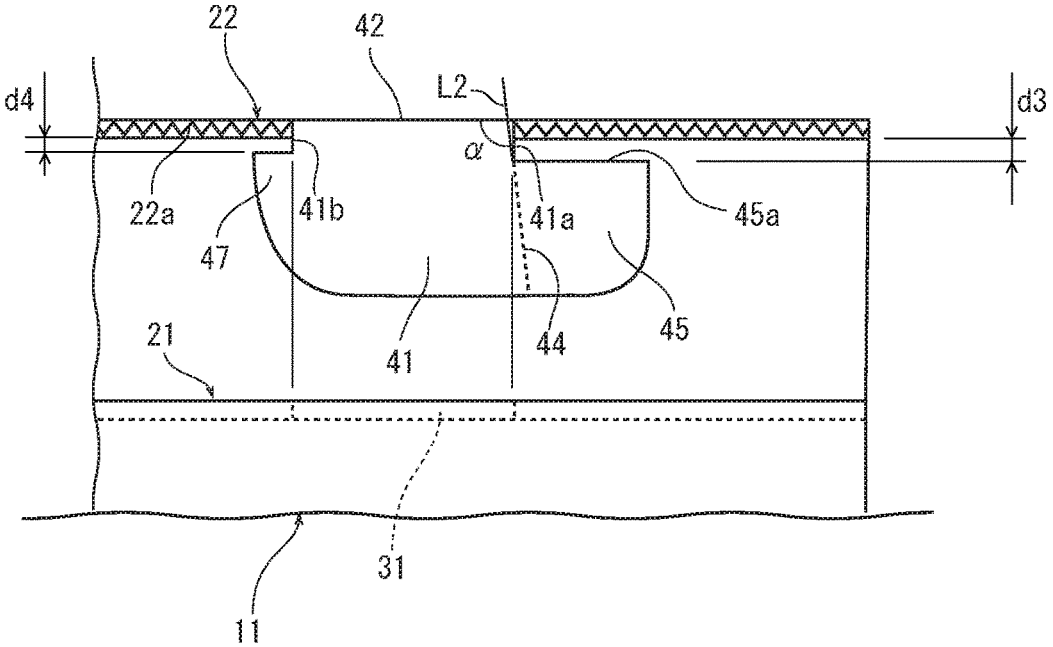
FIG. 4B is a front view showing a positional relationship between the insertion piece and the slit of the packaging box according to the one embodiment of the present disclosure.

The outer flap 22 is formed with insertion pieces 41 along a tip edge 22*a* at a predetermined interval. Each of the insertion pieces 41, as shown in FIG. 4A and FIG. 4B, is bendably connected along a bending line 42 parallel with and inside of the tip edge 22*a*. The bending lines 42 has a length substantially equal to a length of the slit 31 of the inner flap 21. In addition, a break line is formed along the bending line 42, and the insertion pieces 41 can be torn out from the outer flap 22.

Each of the insertion pieces 41 is formed with an engaging piece 45 connected along an outer side edge 41*a* in a direction along the tip edge 22*a* of the outer flap 22 (right and left directions) via a folding line 44 extending in a direction crossing the tip edge 22*a*. The engaging piece 45 has an engaging edge 45*a* facing the tip edge 22*a* of the outer flap 22. An interval d1 between the engaging edge 45*a* and an extension line L1 of the bending line 42 (a length of the side edge 41*a*) is equal to a length obtained by adding a thickness of the inner flap 21 to a thickness of the outer flap 22 (twice of the thickness of the cover flap 3). For example, when the thickness of a corrugated cardboard material suitable for a packaging box for toner cartridge is assumed to be 3 mm, the interval d1 is preferably 6 mm. It is to be noted that when the interval d1 is equal to the interval between the tip edge 22*a* of the outer flap 22 and the extension line L1 of the bending line 42, a gap is not generated between the engaging edge 45*a* of the engaging pieces 45 and the tip edge 22*a* of the outer flap 22. In addition, the engaging pieces 45 are formed such that corners between a tip edge and side edges are curved.

An angle $\alpha$ between an extension line L2 of the folding line 44 and the bending line 42 is an obtuse angle, and the folding line 44 is inclined with respect to the bending line 42. That is, the folding line 44 is formed so as to cross the ridgeline direction of the corrugated cardboard material.

In addition, each of the insertion pieces 41 is formed with a wedge portion 47 along an inner side edge 41*b* in a direction along the tip edge 22*a* of the outer flap 22 protruding outward from an end of the bending line 42. An interval d2 between the wedge portion 47 and the extension line L1 of the bending line 42 (a length of the side edge 41*b*) is 0-1 mm narrower than a length obtained by adding the thickness of the outer flap 22 and the thickness of the inner flap 21. When the thickness of the corrugated cardboard material is 3 mm, the interval d2 is preferably 5-6 mm. Since the interval d2 is shorter than the interval d1, the wedge portion 47 is formed inside of the tip edge 22*a* of the outer flap 22 by a difference length between the interval d2 and the interval d1. In addition, the wedge portion 47 is formed such that a corner between a tip edge and a side edge is curved.

When the insertion piece 41 is bent at a right angle along the bending line 42, as shown in FIG. 4B, an interval d3 between the tip edge 22*a* of the outer flap 22 and the engaging edge 45*a* of the engaging piece 45 is not more than 3 mm, which is equal to the thickness of the inner flap 21. In addition, an interval d4 between the outer flap 22 and the wedge portion 47 is 0-1 mm.

As shown in FIG. 3, the outer flap 22 is formed with a break line 51 parallel with the tip edge 22*a* in the tip portion. Between the break line 51 and the tip edge 22*a*, a zipper 52 (a breaking portion for unsealing) is formed. A handle 53 is formed on one edge of the zipper 52. In addition, a cut and raised piece 54 is formed in the center of the break line 51.

The bottom plate 4 has outer flaps 61 and 62 respectively connected along lower edges of the front and rear side plates 11 and 12 via bending lines, and inner flaps 63 and 64 respectively connected along the lower edges of the right and left side plates 13 and 14 via bending lines. Combining the outer flaps 61 and 62 with the inner flaps 63 and 64 allows the lower opening of the storage part 2 to be closed.

In the packaging box 1 having the above-mentioned configuration, in order to seal the packaging box 1 after an article to be packaged is stored, after the cover receiving flaps 23 and 24 are folded inward, the inner flap 21 are bent inward along the bending line 26. Thereafter, the outer flap 22 is bent inward along the bending line 27 and overlapped on the inner flap 21. At this time, each of the insertion pieces 41 is bent at a right angle along the bending line 42, and the engaging piece 45 is folded along the folding line 44 so as to be overlapped on the insertion piece 41. Then, each of the insertion pieces 41 is inserted into the slit 31. At this time, the insertion piece 41 on which the folded engaging piece 45 is overlapped passes through the wide portion 32 of the slit 31. The wedge portion 47 is crushed by an edge portion of the slit 31 or curved in the slit 31 and then forcefully fitted into the slit 31.

Figure 5:
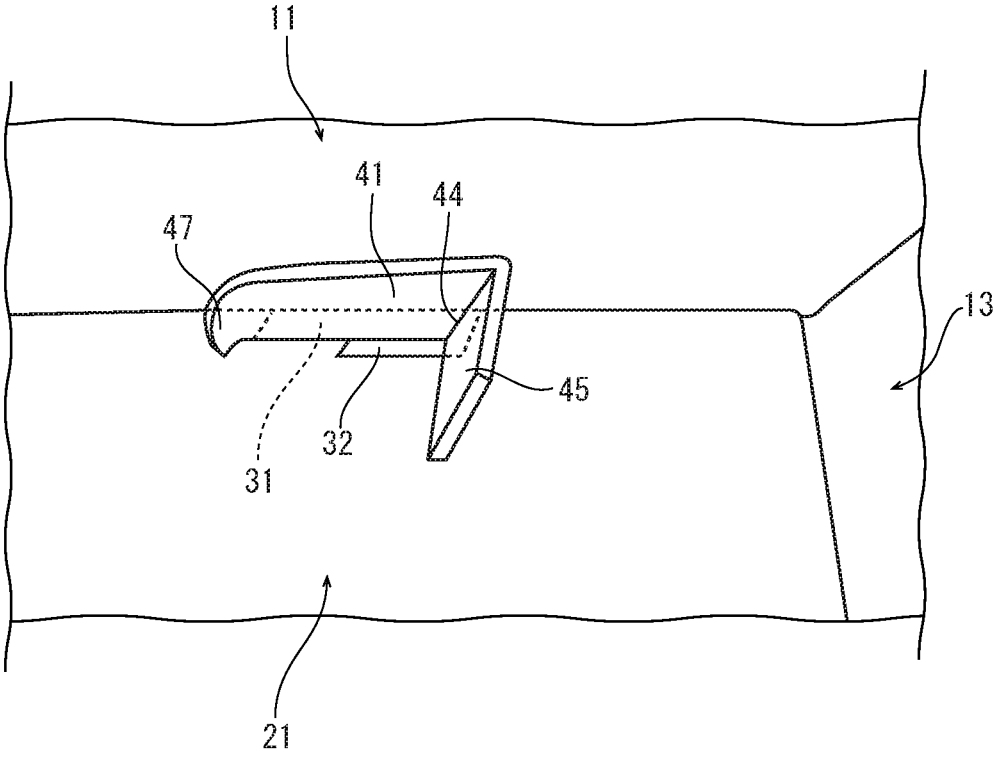
FIG. 5 is a perspective view showing the the insertion piece inserted into the slit, viewed from the inside, of the packaging box according to the one embodiment of the present disclosure.

After each of the insertion pieces 41 is inserted into the slit 31, the engaging piece 45 is unfolded by its resilience and restored to forma predetermined angle with respect to the insertion piece 41. That is, the engaging piece 45 is bent in a direction crossing the slit 31. In addition, the crushed part of the wedge portion 47 protrudes from the end of the slit 31. By the engaging piece 45 and the wedge portion 47 having the configuration described above, as shown in FIG. 5, each of the insertion pieces 41 is prevented from being pulled out of the slit 31, and the outer flap 22 is engaged with the inner flap 21 (see FIG. 1).

When unsealing the packaging box 1, upon breaking of the zipper 52 along the break line 51 holding the handle 53, each of the insertion pieces 41 is cut along the bending line 42 to be separated from the zipper 52, and the zipper 52 is torn out from the outer flap 22. This makes it possible for remaining portion of the outer flap 22 to be unsealed along the bending line 27. Thereafter, the inner flap 21 is opened outward, thereby unsealing the packaging box 1.

It is to be noted that when the packaging box 1 is resealed, the cut and raised piece 54 formed in the center of the break line 51 of the outer flap 22 is inserted into the insertion hole 34 of the inner flap 21.

Figure 6:
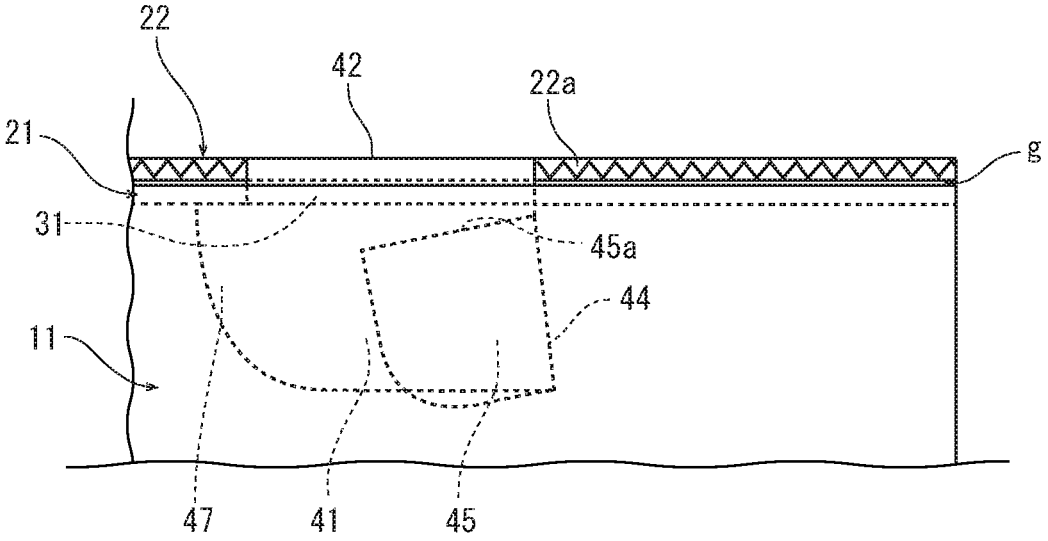
FIG. 6 is a front view showing the insertion piece inserted into the slit in the packaging box according to the one embodiment of the present disclosure.
Figure 7A:
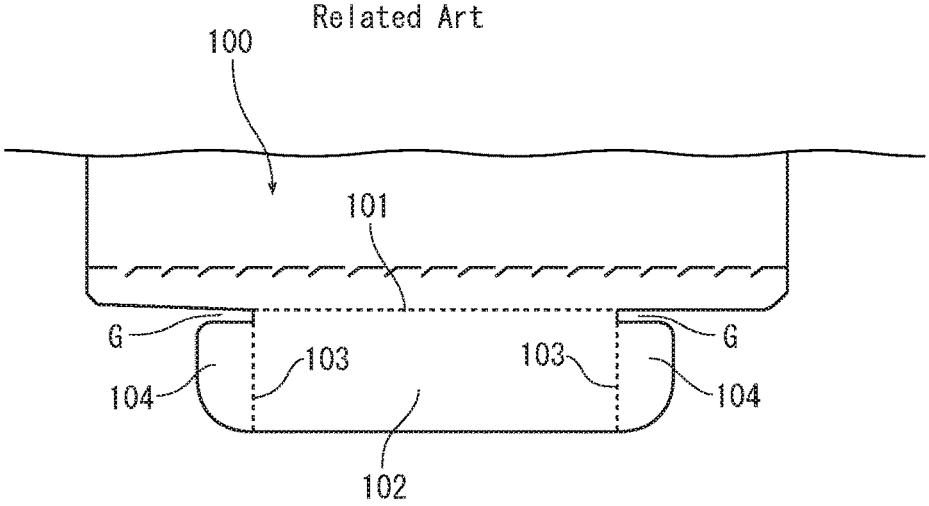
FIG.7A Related Art
FIG. 7A is a plan view showing an insertion piece of a conventional packaging box.
Figure 7B:
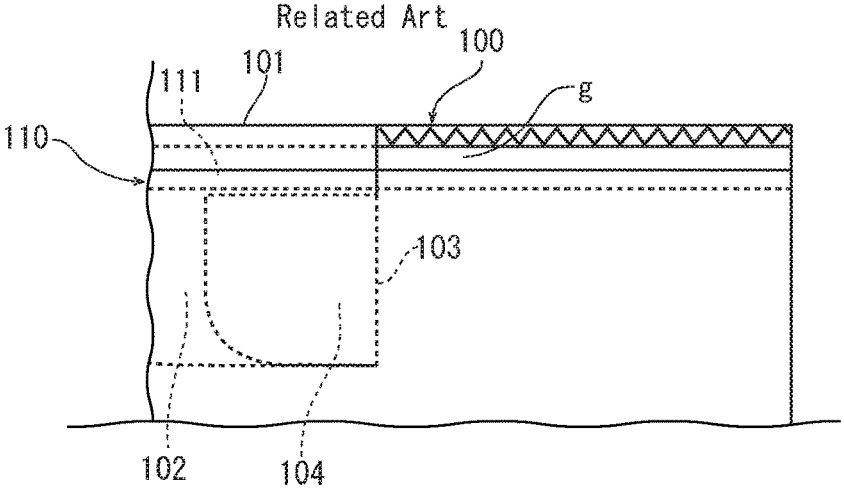
FIG.7B Related Art
FIG. 7B is a front view showing the insertion piece inserted into the slit in the conventional packaging box.
Figure 7C:
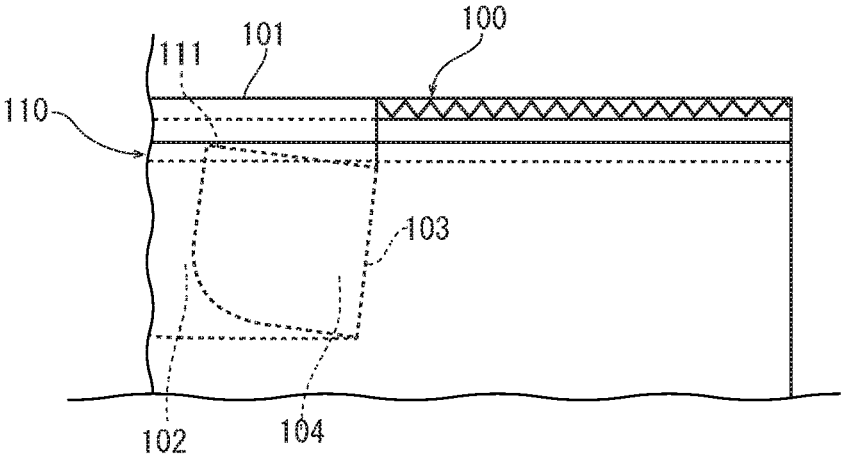
FIG.7C Related Art
FIG. 7C is a front view showing then engaging piece with the slit in the conventional packaging box.

As described above, in the packaging box 1 of the present disclosure, when the insertion piece 41 is bent along the bending line 42, a gap that is substantially equal to the thickness of the inner flap 21 is generated between the tip edge 22*a* of the outer flap 22 and the engaging piece 45(see FIG. 4B), and the inner flap 21 is interposed in this gap. That is, as shown in FIG. 6, since the interval of the gap g between the outer flap 22 and the inner flap 21 is very narrow or there is no gap g, uplift of the outer flap 22 can be prevented and there is no risk that the packaging box 1 is mistaken as being unsealed.

However, when the gap between the engaging piece 45 and the tip edge 22*a* of the outer flap 22 is narrow as described above, the packaging box 1 may be hardly unsealed because the engaging piece 45 interferes with a side face of the slit 31 and/or a lower surface of the inner flap 21. However, in the packaging box 1 of the present disclosure, since the folding line 44 of the engaging piece 45 is inclined, the folded engaging piece 45 does not interfere with the slit 31 and thus the packaging box 1 can be surely unsealed. That is, as shown in FIG. 6, since the folding line 44 is inclined at an obtuse angle with respect to the bending line 42, the engaging piece 45 is folded in a direction apart from the bending line 42, in other words, a direction apart from the slit 31. In other words, after the insertion piece 41 has been inserted into the slit 31, the engaging edge 45*a* of the engaging piece 45 is inclined away from the folding line 44 downward toward a direction apart from the inner flap 21. Therefore, irrespective of variance in folding manners, the engaging piece 45 does not get contact with the side face of the slit 31 and/or the lower surface of the inner flap 21 before unfolding. Therefore, the outer flap 22 can be surely engaged with the inner flap 21 by the engaging edge 45*a* of the unfolded engaging piece 45.

In addition, the folding line 44 is formed so as to cross the ridgeline direction of the corrugating medium of the corrugated cardboard material. Therefore, since it is necessary to fold the engaging piece 45 against the ridgeline direction, the engaging piece 45 is hard to be folded. However, if a cutting line is formed along a part of the folding line 44, the engaging piece 45 can be surely folded. However, even if the cutting line is formed, since the engaging piece 45 is likely to be returned in the ridgeline direction upon unfolding, the engaging piece 45 can be surely unfolded.

Further, the wedge portion 47 formed in the insertion piece 41 enables sure sandwiching the inner flap 21 between the outer flap 22 and the wedge portion 47 in a root portion of the insertion piece 41. Particularly, since the interval between the wedge portion 47 and the bending line 42 is set to be short, the sandwiching force can be enhanced. That makes it possible for the outer flap 22 to enhance engaging force of the inner flap 21 with the outer flap 22 while preventing the outer flap 22 from being uplifted.

It is to be noted that, in the present embodiment, the packaging box 1 formed with the breaking portion 52 for unsealing has been described. Meanwhile, the present disclosure can also apply to a packaging box having no breaking portion 52 for unsealing and/or a packaging box having a breaking portion for unsealing having a different shape from the breaking portion 52 for unsealing.

It is to be noted that the packaging box 1 of the present disclosure can be used for packaging consumable supplies and materials other than a toner cartridge, groceries or the like.

Further, description of the embodiment of the present disclosure described above describes a suitable embodiment in the packaging box according to the present disclosure. Therefore, the description may add technically preferred various limitations, but the technical scope of the present disclosure is not limited to these embodiments unless there is description particularly limiting the present disclosure. In other words, components in the embodiment of the present disclosure described above can be appropriately exchanged with existing components, and various variations including combinations with other existing components are possible. The description of the embodiment of the present disclosure described above does not limit the content of the disclosure described in claims.

What is claimed is:

1. A packaging box comprising:

a storage part including a rectangular bottom plate and side plates respectively standing upright from four side edges of the rectangular bottom plate and formed with an opening on one face, an inner flap configured to be bent inward along an edge of one side plate of a pair of the side plates facing each other; and an outer flap configured to be bent inward along an edge of the other side plate and to be overlapped on the inner flap to close the opening, wherein the inner flap is provided with a slit along the edge and the outer flap is provided with an insertion piece connected to a tip edge thereof via a bending line, the insertion piece being inserted into the slit by being bent along the bending line, wherein the insertion piece has an engaging piece configured to be foldable along a folding line extending in a direction crossing the tip edge of the outer flap and to have an engaging edge facing the tip edge of the outer flap, the engaging piece being insertable into the slit by being folded along the folding line so as to be overlapped on the insertion piece and being unfolded by its resilience and bent in a direction crossing the slit after the insertion so that the engaging edge prevents the insertion piece from being pulled out of the slit, wherein the folding line is inclined at an obtuse angle with respect to the bending line such that when the engaging piece is folded along the folding line, the engaging edge is inclined downward toward its distal end, wherein the slit has a wide portion through which the insertion piece on which the engaging piece folded along the folding line is overlapped can be passed, and the wide portion is stepwisely formed along the edge of the side plate.

2. The packaging box according to claim 1, wherein the outer flap is formed with a breaking portion at a tip portion, in which the breaking portion is broken at the time of unsealing.

3. The packaging box according to claim 1, wherein the storage part is made of a cardboard material having a corrugated medium with a ridgeline of the corrugated medium directing in upper and lower directions and the folding line is formed along a direction crossing the ridgeline direction of the corrugated medium of the corrugated cardboard material.

4. The packaging box according to claim 1, wherein a length of the bending line in a direction along the tip edge of the outer flap is equal to a length of the slit, and the insertion piece has a wedge portion protruding outward from an end of the bending line in a direction along the tip edge of the outer flap on an opposite side of the engaging piece.

5. The packaging box according to claim 4, wherein an interval between the extension line of the bending line and the wedge portion is shorter than the interval between the extension line of the bending line and the engaging edge of the engaging piece.

6. The packaging box according to claim 2, wherein the outer flap has a cut and raised part erected with a break of the breaking portion for unsealing, and the inner flap has an insertion hole with which the cut and raised part is engageable.

7. The packaging box according to claim 1 storing a toner cartridge.

* * * * *